US007208874B2

(12) United States Patent
Niigaki et al.

(10) Patent No.: US 7,208,874 B2
(45) **Date of Patent: *Apr. 24, 2007**

(54) TRANSMITTING TYPE SECONDARY ELECTRON SURFACE AND ELECTRON TUBE

(75) Inventors: Minoru Niigaki, Hamamatsu (JP); Shoichi Uchiyama, Hamamatsu (JP); Hirofumi Kan, Hamamatsu (JP)

(73) Assignee: Hamamatsu Photonics K. K., Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/507,011

(22) PCT Filed: Feb. 24, 2003

(86) PCT No.: PCT/JP03/01992

§ 371 (c)(1),
(2), (4) Date: Sep. 8, 2004

(87) PCT Pub. No.: WO03/077271

PCT Pub. Date: Sep. 18, 2003

(65) Prior Publication Data

US 2005/0104527 A1 May 19, 2005

(30) Foreign Application Priority Data

Mar. 8, 2002 (JP) ..... 2002-064165

(51) Int. Cl.
*H01J 40/06* (2006.01)
*H01J 43/00* (2006.01)

(52) U.S. Cl. ..... 313/542; 313/103 R

(58) Field of Classification Search ..... 315/167, 315/168; 313/523, 525, 527–528, 530–532, 313/540, 542, 103 R, 104
See application file for complete search history.

(56) References Cited

U.S. PATENT DOCUMENTS 5,729,244 A * 3/1998 Lockwood ..... 345/75.2
5,959,400 A * 9/1999 Niigaki et al. ..... 313/495
5,977,705 A * 11/1999 Sinor et al. ..... 313/542
5,982,094 A * 11/1999 Niigaki et al. ..... 313/542
5,986,387 A * 11/1999 Niigaki et al. ..... 313/103 R
6,060,839 A * 5/2000 Sverdrup et al. ..... 315/160

(Continued)

FOREIGN PATENT DOCUMENTS

JP 10-144251 5/1998
JP 10-223131 8/1998
JP 10-223162 8/1998

(Continued)

OTHER PUBLICATIONS

Mearini et al., "Fabrication of an electron multiplier utilizing diamond films," Thin Solid Films, 253, (1994), pp. 151-156.

*Primary Examiner*—Thuy Vinh Tran
(74) *Attorney, Agent, or Firm*—Drinker Biddle & Reath LLP

(57) ABSTRACT

A transmission secondary electron emitter is provided which emits secondary electrons generated by the incidence of primary electrons. The transmission secondary electron emitter includes a secondary electron emitting layer which is made of diamond or a material containing diamond as a main component, and of which one surface is the surface of incidence for making the primary electrons incident thereon, and the other surface is the surface of emission for emitting the secondary electrons. Also included is a voltage applying arrangement for applying a predetermined voltage between the surfaces of the incidence and the emission of the secondary electron emitting layer to form an electric field in the secondary electron emitting layer.

13 Claims, 8 Drawing Sheets

U.S. PATENT DOCUMENTS

| | | | | |
|---|---|---|---|---|
| 6,333,968 | B1 * | 12/2001 | Whitlock et al. | 378/136 |
| 6,396,049 | B1 * | 5/2002 | Estrera et al. | 250/124 VT |
| 6,657,385 | B2 * | 12/2003 | Tomasetti et al. | 313/527 |
| 6,674,235 | B2 * | 1/2004 | Lim et al. | 313/542 |
| 6,828,730 | B2 * | 12/2004 | Eden et al. | 313/538 |
| 2002/0041154 | A1 * | 4/2002 | Tomasetti et al. | 313/527 |

FOREIGN PATENT DOCUMENTS

| | | |
|---|---|---|
| JP | 11-233000 | 8/1999 |
| JP | 2000-357449 | 12/2000 |
| JP | 2001-006531 | 1/2001 |
| JP | 2001-233694 | 8/2001 |

* cited by examiner

TRANSMITTING TYPE SECONDARY ELECTRON SURFACE AND ELECTRON TUBE

This Application is a National Phase Application under 35 U.S.C. 371 claiming the benefit of PCT/JP03/01992 filed on Feb. 24, 2003, which has priority based on Japan Application No. 2002-64165 filed on Mar. 08, 2002.

FIELD OF THE ART

The present invention relates to a transmission secondary electron emitter emitting secondary electrons generated by primary electrons made incident, and an electron tube provided with the transmission secondary electron emitter.

BACKGROUND ART

Attention has been recently focused on a secondary electron emitter which is used for an electron tube and uses diamond. The reason for this is that the diamond has negative electron affinity, and the diamond has high secondary electron-emission efficiency. One example is reported in "Thin Solid Films 253(1994) p 151." In the example, the diamond is used as a material for a reflection type secondary electron emitter of which the surface of emission for emitting secondary electrons is the same as the surface of incidence for making primary electrons incident thereon. That is, in the secondary electron emitter, a polycrystalline diamond thin film of which the surface is terminated with hydrogen is formed on a substrate made of Mo, Pd, Ti or AlN or the like, and the emission efficiency of the second electron is improved.

DISCLOSURE OF THE INVENTION

Since the surface of the incidence is the same as the surface of the emission in the above reflection type secondary electron emitter, the change in the surface condition such as the desorption of hydrogen termination is caused by the primary electrons made incident, and thereby the emission efficiency of the secondary electron is lowered. In order to solve this drawback, a transmission secondary electron emitter of which the surface of the incidence is different from the surface of the emission is disclosed (Japanese Patent Application Laid-Open No. H10-144251 and U.S. Pat. No. 5,986,387).

FIG. 11 is a construction view illustrating an embodiment of an electron tube provided with a conventional transmission secondary electron emitter. The electron tube is provided with a cathode 101 having a photoelectron emission surface, a transmission secondary electron emitter 102, and an anode 103. The transmission secondary electron emitter 102 comprises a diamond thin film 102*a*, and a reinforcing means 102*b* for reinforcing the rigidity thereof. Herein, when photoelectrons are emitted from the cathode 101 by the incidence of light, the photoelectrons are made incident on the secondary electron emitter 102 to generate secondary electrons, and the secondary electrons are emitted to the anode 103. A fluorescent substance 103*a* coated on a glass surface plate 103*b* emits light by the secondary electrons made incident on the anode 103.

As shown in FIG. 12, a transmission secondary electron emitter is also disclosed, which uses diamond and makes secondary electrons accelerate by applying a voltage to an anode facing the surface of emission of a secondary electron emitter (U.S. Pat. No. 6,060,839). When primary electrons pass through an electrode 105, and are made incident on a diamond thin film 106 in the transmission secondary electron emitter, the secondary electrons are generated, and emitted. The secondary electrons are accelerated in the direction of the anode 107 by the electric field formed by applying a voltage to the anode 107.

However, the above transmission secondary electron emitter has not had the practical emission efficiency of secondary electrons. This is a result of the following reasons. That is, the secondary electrons generated by the incidence of the primary electrons are moved to the surface of the emission of the side opposite to the surface of the incidence on the transmission secondary electron emitter, and the secondary electrons should be emitted from the surface thereof. To that end, a diamond film of which the film thickness is the diffusion length (mean free path) of the electron and which is very thin is required.

The experimental result of photoelectron emission by the present inventor has shown that the diffusion length of the electron in the diamond film is about 0.05 μm. Therefore, it is necessary to adjust the film thickness of the diamond thin film to the same level as the diffusion length, that is, about 0.05 μm in order to emit the secondary electrons efficiently on the transmission secondary electron emitter. However, it is actually difficult to achieve the above transmission secondary electron emitter because of a deficiency in the mechanical strength and poor uniformity of the diamond film having a very thin thickness.

On the other hand, though the film thickness of at least several μm is required for sufficient mechanical strength of the diamond thin film, the secondary electrons generated by the incidence of the primary electrons hardly reach the surface of the emission of the side opposite to the surface of the incidence in the thick film. Therefore, the emission efficiency of the secondary electron is remarkably lowered as a result, and the practical transmission secondary electron emitter cannot be achieved.

The present invention has been made to solve the aforementioned problems. It is an object of the present invention to provide a transmission secondary electron emitter which can emit the secondary electrons efficiently for the incidence of the primary electrons, and an electron tube using the same.

In order to achieve the aforementioned object, the transmission secondary electron emitter according to the present invention which emits secondary electrons generated by the incidence of primary electrons, the transmission secondary electron emitter comprises: a secondary electron emitting layer which is made of diamond or a material containing diamond as a main component, and of which one surface is the surface of incidence for making the primary electrons incident thereon, and the other surface is the surface of emission for emitting the secondary electrons; and a voltage applying means for applying a predetermined voltage between the surfaces of the incidence and the emission of the secondary electron emitting layer.

According to the above construction, the transmission secondary electron emitter has a transmission construction in which one surface of the secondary electron emitting layer is the surface of the incidence, and the other surface is the surface of the emission. Thereby the construction prevents the change in the surface condition of the surface of the emission by the incidence of the primary electrons, and the decrease in the emission efficiency of the secondary electrons can be prevented. The secondary electron emitting layer is made of diamond or a material containing diamond as a main component, and thereby the emission efficiency of the secondary electrons according to the primary electrons can be improved. The voltage applying means forms the electric field in the secondary electron emitting layer. Thereby the secondary electrons reach the surface of the emission easily, and the secondary electrons can be emitted with high efficiency.

The electron tube according to the present invention comprises: the above transmission secondary electron emitter; an electron source for emitting the primary electrons to the transmission secondary electron emitter; an anode for collecting secondary electrons emitted from the transmission secondary electron emitter; and an envelope for accommodating the transmission secondary electron emitter, the electron source, and the anode. The use of the transmission secondary electron emitter for the electron tube provides an electron tube which can efficiently obtain the secondary electrons from the incidence of the primary electrons.

BRIEF DESCRIPTION OF THE DRAWINGS

FIG. 6A is a side cross-sectional view, and FIG. 6B is a bottom view.

BEST MODE FOR CARRYING OUT THE INVENTION

Hereinafter, the preferred embodiments of the transmission secondary electron emitter and the electron tube according to the present invention will be described in detail with reference to the drawings. In the explanation of drawings, elements identical to each other will be referred to with numerals identical to each other without overlapping descriptions. The measurement ratio of the drawings does not necessarily correspond to that of the description.

Figure 1:
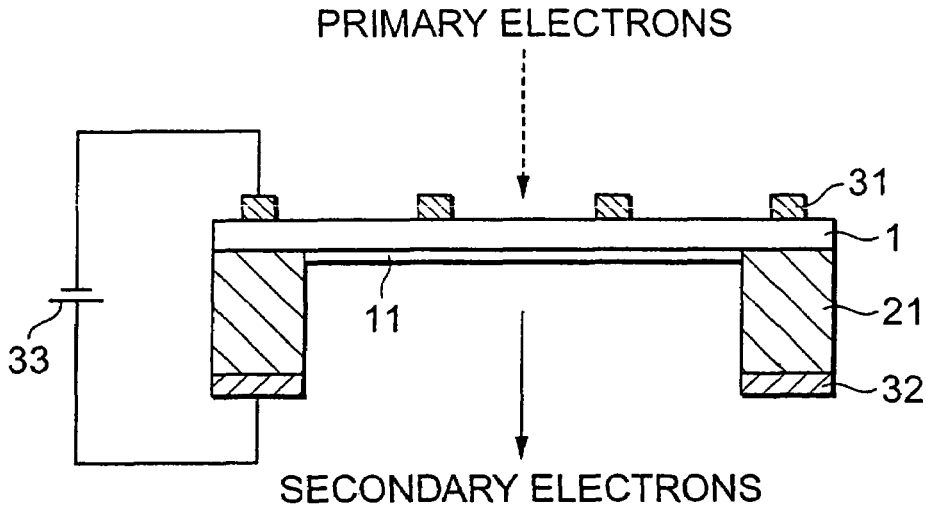
FIG. 1 is a side cross-sectional view illustrating the construction of a transmission secondary electron emitter according to the first embodiment of the present invention.
Figure 2:
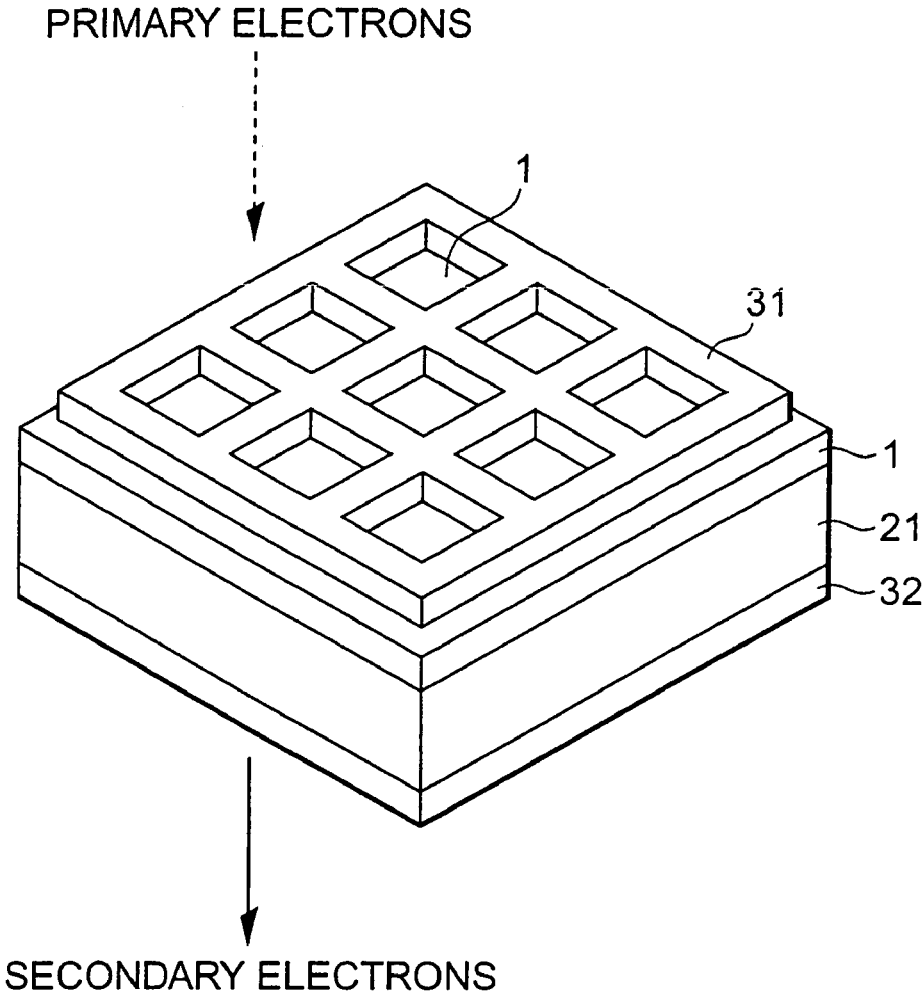
FIG. 2 is a perspective view of the transmission secondary electron emitter shown in FIG. 1.

FIG. 1 is a side cross-sectional view illustrating the construction of a transmission secondary electron emitter according to the first embodiment of the present invention. FIG. 2 is a perspective view of the transmission secondary electron emitter shown in FIG. 1.

A transmission secondary electron emitter illustrated in FIG. 1 comprises a secondary electron emitting layer 1, a supporting frame 21, a first electrode 31 and a second electrode 32. In the transmission secondary electron emitter, secondary electrons are generated in the secondary electron emitting layer 1 by an incidence of primary electrons, and secondary electrons are emitted outside. The transmission secondary electron emitter has a transmission type construction. One surface (an upper surface in FIG. 1) of the secondary electron emitting layer 1 is the surface of the incidence for making the primary electrons incident thereon, and the other surface (a lower surface in FIG. 1) of the side opposite thereto is the surface of the emission for emitting the secondary electrons.

The secondary electron emitting layers 1 are made of a diamond film formed by diamond or a material containing diamond as a main component. It is preferable that the secondary electron emitting layer 1 is formed to be sufficiently thicker than the incidence depth of the primary electrons. It is preferable that the surface of the emission of the secondary electron emitting layer 1 is terminated with hydrogen or oxygen.

The supporting frame 21 is a supporting means for reinforcing the mechanical strength of the secondary electron emitting layer 1 formed thinly. The supporting frame 21 is made of a material such as Si, and is arranged on the outer edge part of the surface of the emission of the secondary electron emitting layer 1.

The first electrode 31 formed on the surface of the incidence of the secondary electron emitting layer 1 is an electrode of an incident surface side. As shown in FIG. 2, in this embodiment, the first electrode 31 is formed in a lattice shape on the surface of the incidence of the secondary electron emitting layer 1. The second electrode 32 formed on the surface of the emission of the secondary electron emitting layer 1 is an electrode of an emission surface side. In this embodiment, the second electrode 32 is formed on the whole surface of the side opposite to the secondary electron emitting layer 1 of the supporting frame 21. The first electrode 31 and the second electrode 32 are arranged as a voltage applying means for applying a voltage between the surfaces of the incidence and the emission of the secondary electron emitting layer 1 to form an electric field in the secondary electron emitting layer 1.

An active layer 11 for lowering the work function of the surface of the emission is formed on the surface of the emission of the secondary electron emitting layer 1.

In the above construction of the transmission secondary electron emitter, when the primary electrons are made incident on the surface of incidence of the secondary electron emitting layer 1, the secondary electrons corresponding to the incident energy of the primary electrons are generated in the secondary electron emitting layer 1. An electric field in which the side of the surface of the emission is positive and the side of the surface of the incidence is negative is formed in the secondary electron emitting layer 1, by applying a predetermined voltage using a power supply 33 connected between the first electrode 31 and the second electrode 32. The secondary electrons generated in the secondary electron emitting layer 1 are accelerated in the direction to the surface of the emission by the electric field. After the secondary electrons reach the surface of the emission, the secondary electrons pass through the active layer 11, and are emitted outside of the transmission secondary electron emitter.

The transmission secondary electron emitter of this embodiment can achieve the following effects.

The transmission secondary electron emitter shown in FIG. 1 has a transmission type construction in which one surface of the secondary electron emitting layer 1 is the surface of the incidence and the other surface is the surface of the emission. Thus, the change in the surface condition of the surface of the emission due to the incidence of the primary electrons is prevented not by the reflection type construction in which the surface of incidence on which the primary electrons are made incident is the surface of emission on which the secondary electrons are emitted, but by the transmission type construction. As a result, since the change in the work function on the surface of the emission is suppressed, the decrease in the emission efficiency of the secondary electrons can be prevented.

The secondary electron emitting layer 1 is formed by using diamond or a material containing diamond as a main component. Since the diamond has negative electron affinity, the diamond has a high emission efficiency of the secondary electrons. Therefore, the secondary electron emitting layer 1 can emit the secondary electrons efficiently for the incidence of the primary electrons.

The first electrode 31 is formed on the side of the surface of the incidence of the secondary electron emitting layer 1, and the second electrode 32 is formed on the side of the surface of the emission. Thereby, the electric field is formed in the secondary electron emitting layer 1. This can make the secondary electrons generated in the secondary electron emitting layer 1 reach the surface of the emission efficiently, and thereby the efficiency for emitting the secondary electrons outside of the transmission secondary electron emitter can be improved.

Usually, it is necessary to form the thickness of the secondary electron emitting layer 1 to the same extent as the diffusion length (mean free path) of the secondary electrons for emitting the secondary electrons generated in the secondary electron emitting layer 1 outside of the secondary electron emitting layer 1. However, it is difficult to form the secondary electron emitting layer 1 having such a thickness as diamond and a diamond film containing diamond as a main component.

Correspondingly, in the transmission secondary electron emitter of this embodiment, the electric field is formed in the secondary electron emitting layer 1, and the secondary electrons generated in the secondary electron emitting layer 1 are accelerated to the surface of the emission. Even when the thickness of the secondary electron emitting layer 1 is thicker than the diffusion length, several μm for example, the secondary electrons can be efficiently emitted.

Herein, it is preferable to use polycrystalline diamond or a material containing polycrystalline diamond as a main component as the material of the secondary electron emitting layer 1. Since the polycrystalline diamond is made of granular crystals, the polycrystalline diamond has grain boundary faces as the surfaces of the granular crystals. The secondary electrons are emitted from the grain boundary faces existing in all directions that the secondary electrons generated in the secondary electron emitting layer 1 diffuse.

Therefore, in the polycrystalline diamond, the distance from the generation of the secondary electrons to the emission thereof is shortened, and the number of the secondary electrons emitted increases. As a result, the higher emission efficiency can be obtained. Also, the polycrystalline diamond can be produced in a large volume at low cost in comparison with monocrystalline diamond. If the polycrystalline diamond is used as a material of the secondary electron emitting layer 1, the manufacturing cost of the transmission secondary electron emitter can be suppressed.

The supporting frame 21 is arranged as a supporting means on the outer edge part of the surface of the emission of the secondary electron emitting layer 1. Since the secondary electron emitting layer 1 is thinly formed for emitting the secondary electrons generated in the secondary electron emitting layer 1, the secondary electron emitting layer 1 may have an insufficient mechanical strength. Thus, when it is necessary to reinforce the mechanical strength of the secondary electron emitting layer 1, it is preferable that the supporting means such as the supporting frame 21 is arranged at a suitable position such as the outer edge part of the surface of the emission. As a result, the mechanical strength of secondary electron emitting layer 1 can be reinforced.

The surface of the emission of the secondary electron emitting layer 1 is preferably terminated with oxygen. The surface of the emission of the secondary electron emitting layer 1 is terminated with oxygen, and thereby the surface of the emission of the secondary electron emitting layer 1 is stabilized, and the electrical property can be retained for a long time. The surface of the emission of the secondary electron emitting layer 1 may be terminated with hydrogen. Even when the surface of the emission is terminated with hydrogen, the work function of the surface of the emission of the secondary electron emitting layer 1 can be lowered, and the secondary electrons which reach the surface of the emission can be easily emitted outside of the transmission secondary electron emitter.

When the secondary electron emitting layer 1 is made of polycrystalline diamond or a material containing polycrystalline diamond as a main component, the surface and the grain boundary faces of the polycrystalline diamond of the secondary electron emitting layer 1 are preferably terminated with oxygen. The surface of the emission of the secondary electron emitting layer 1 is stabilized by terminating the surface and the grain boundary faces with oxygen, and the electrical property can be retained for a long time.

Since the transmission secondary electron emitter shown in FIG. 1 has a transmission type construction, the primary electrons are not made incident on the surface of the emission, and the surface condition due to the above terminal process is not changed. As a result, the emission efficiency of the secondary electrons improved by the terminal process can be maintained.

It is preferable that the active layer 11 which lowers the work function of the diamond is formed on the surface of the emission of the secondary electron emitting layer 1. The secondary electrons which reach the surface of the emission of the secondary electron emitting layer can be more easily emitted from the surface of the emission of the secondary electron emitting layer 1 by lowering the work function of the surface of the emission of the secondary electron emitting layer 1. The above effect can be suitably achieved by forming the active layer by using an alkali metal, an oxide of the alkali metal, or a fluoride of the alkali metal or the like.

A process for manufacturing the transmission secondary electron emitter shown in FIG. 1 and one example of a specific construction will be described. FIG. 3A to FIG. 3E are process charts illustrating the manufacturing process of the transmission secondary electron emitter shown in FIG. 1.

Figure 3A:
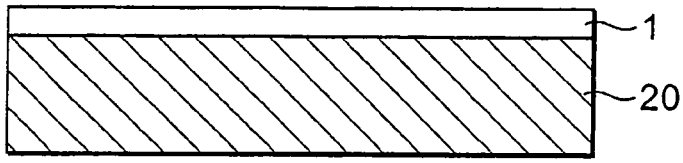
FIGS. 3A to 3E are process charts illustrating the manufacturing process of the transmission secondary electron emitter shown in FIG. 1.

The secondary electron emitting layer 1 made of the polycrystalline diamond is deposited by about 5 μm thickness on one surface of a substrate 20 made of Si (FIG. 3A). Synthesis methods by a chemical vapor deposition method (CVD method) using a heat filament or a micro wave plasma and a laser ablation method or the like can be used as a method for forming the layer of the thin polycrystalline diamond. The material of the substrate 20 is not limited to Si. High melting metals such as molybdenum and tantalum, and quartz and sapphire may be used.

Figure 3B:
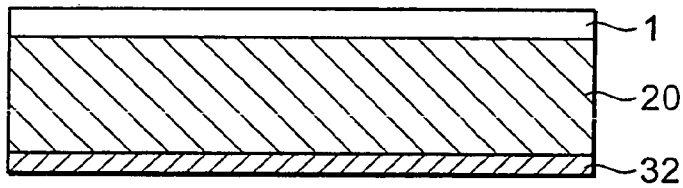
Figure 3C:
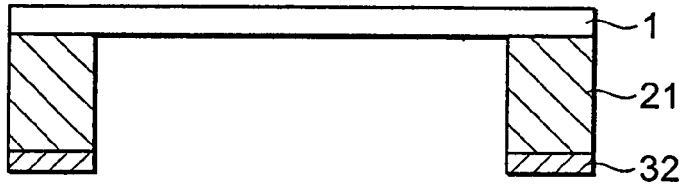

The second electrode 32 is then formed on the other surface of the substrate 20 by evaporation (FIG. 3B). A part of the second electrode 32 and the substrate 20 is removed by etching using a mask of an appropriate dimension from the other surface of the substrate 20, and the secondary electron emitting layer 1 is partially exposed (FIG. 3C). The etching is executed by a $HF+HNO_3$ solution or a KOH solution. When the substrate 20 is etched, and the secondary electron emitting layer 1 is exposed, the etching is automatically stopped. A part which has not been removed by etching in the substrate 20 has a function for reinforcing the mechanical strength of the secondary electron emitting layer 1 as the supporting frame 21.

Figure 3D:
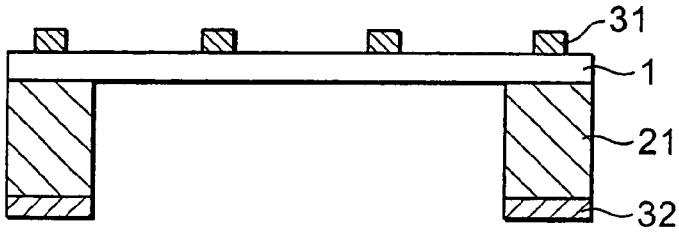

A lattice-shaped first electrode 31 of an appropriate dimension is formed on the surface (the surface of the incidence) of the side opposite to the surface (the surface of the emission) of the secondary electron emitting layer 1 exposed by the etching using a photolithographic technique and a lift-off technique (FIG. 3D). After these are maintained in vacuum, and the surface of the emission of the secondary electron emitting layer 1 is cleaned, the surface of the emission or the like is terminated with oxygen or hydrogen.

Figure 3E:
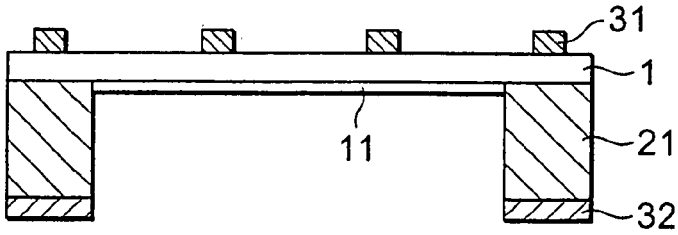

Finally, a material having a property for lowering the work function of the surface of the diamond such as an alkali metal, an oxide of the alkali metal, and a fluoride of the alkali metal is coated on the surface of the emission of the secondary electron emitting layer 1 to form the active layer 11 (FIG. 3E).

The transmission secondary electron emitter of the first embodiment can be produced by the above manufacturing process. However, the process for manufacturing the transmission secondary electron emitter and the specific construction thereof are not limited to the example, and various processes and the constructions can be used.

Figure 4:
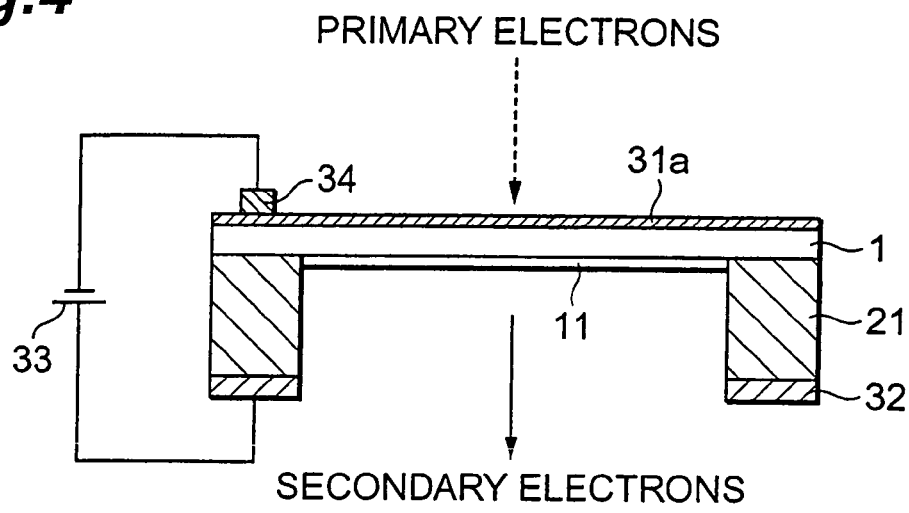
FIG. 4 is a side cross-sectional view illustrating the construction of the transmission secondary electron emitter according to the second embodiment.

FIG. 4 is a side cross-sectional view illustrating the construction of the transmission secondary electron emitter according to the second embodiment.

The transmission secondary electron emitter shown in FIG. 4 comprises the secondary electron emitting layer 1, the active layer 11, the supporting frame 21, a first electrode film 31*a*, an auxiliary electrode 34 and the second electrode 32. Of these, the constructions of the secondary electron emitting layer 1, the active layer 11, the supporting frame 21 and the second electrode 32 are identical to those of the transmission secondary electron emitter shown in FIG. 1.

The first electrode film 31*a* is formed in the film state on the surface of the incidence of the secondary electron emitting layer 1. The first electrode film 31*a* is very thinly formed (the thickness of about 30 to 150 Å) such that the secondary electrons generated in the secondary electron emitting layer 1 are not absorbed by the first electrode film 31*a*. The auxiliary electrode 34 is formed at the predetermined position on the first electrode film 31*a* for the electric connection to the first electrode film 31*a* formed in the film state.

The transmission secondary electron emitter of this embodiment has a transmission type construction. One surface of the secondary electron emitting layer 1 are the surface of the incidence, and the other surface is the surface of the emission. This construction prevents the change in the surface condition of the surface of the emission, and the decrease in the discharge efficiency of the secondary electrons can be prevented. Since the secondary electron emitting layers 1 is formed by using diamond or a material containing diamond as a main component, the secondary electron emitting layer 1 can emit the secondary electrons with high efficiency for the incidence of the primary electrons.

The first electrode film 31*a* and the second electrode 32 are respectively formed on the side of the surface of the incidence of the secondary electron emitting layer 1 and on the side of the surface of the emission, and thereby the electric field is formed in the secondary electron emitting layer 1. The electric field is formed in the secondary electron emitting layer 1, and the secondary electrons generated in the secondary electron emitting layer 1 are accelerated to the surface of the emission. Thereby the secondary electrons can be efficiently emitted outside of the transmission secondary electron emitter.

The first electrode film 31*a* is formed in the thin film state on the surface of the incidence of the secondary electron emitting layer 1. Though the transmission secondary electron emitter can be suitably operated by forming the electrode which is in contact with the secondary electron emitting layer 1 among the electrodes composing the voltage applying means as is the case with the first electrode 31 shown in FIG. 1, the electrodes are preferably formed in the film state as shown in FIG. 4 by methods such as a deposition when it is necessary to make the manufacturing process simple.

In this case, the voltage applying means for improving the emission efficiency of the secondary electrons of the transmission secondary electron emitter can be arranged by a simplified process. The primary electrons can reach the secondary electron emitting layer 1 without being absorbed to the first electrode film 31*a* by forming the first electrode film 31*a* very thinly as described above.

Figure 5:
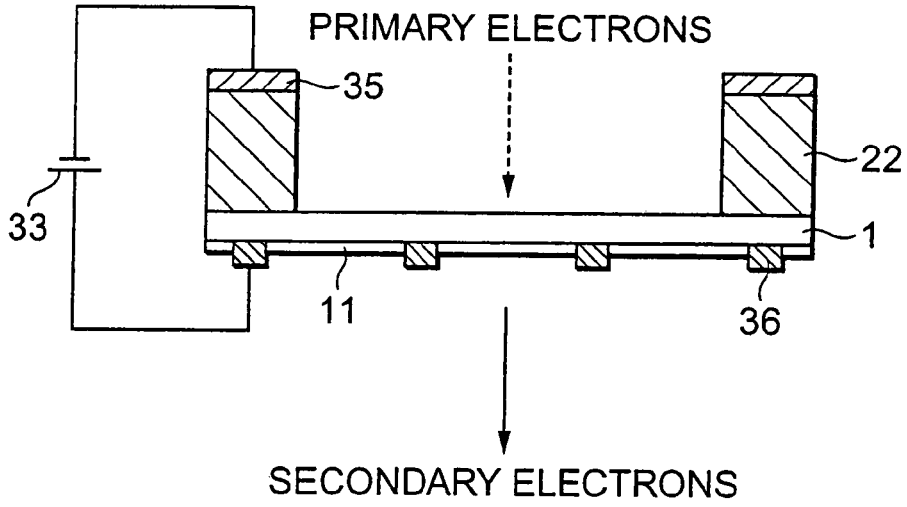
FIG. 5 is a side cross-sectional view illustrating the construction of the transmission secondary electron emitter according to the third embodiment.

FIG. 5 is a side cross-sectional view illustrating the construction of the transmission secondary electron emitter according to the third embodiment.

The transmission secondary electron emitter shown in FIG. 5 comprises the secondary electron emitting layer 1, the active layer 11, a supporting frame 22, a first electrode 35 and a second electrode 36. Of these, the constructions of the secondary electron emitting layer 1 and the active layer 11 are identical to those of the transmission secondary electron emitter shown in FIG. 1.

The supporting frame 22 is a supporting means for reinforcing the mechanical strength of the secondary electron emitting layer 1 formed thinly. The supporting frame 22 is arranged on the outer edge part of the surface of the incidence of the secondary electron emitting layer 1.

The first electrode 35 formed on the surface of the incidence of the secondary electron emitting layer 1 is an electrode of an incident surface side. In this embodiment, the first electrode 35 is formed on the whole surface of the side opposite the secondary electron emitting layer 1 of the supporting frame 22. The second electrode 36 formed on the surface of the emission of the secondary electron emitting layer 1 is an electrode of an emission surface side. In this embodiment, a second electrode 36 is formed in a lattice shape on the surface of the emission of the secondary electron emitting layer 1. The first electrode 35 and the second electrode 36 are arranged as voltage applying means for applying a voltage between the surfaces of the incidence and the emission of the secondary electron emitting layer 1 to form an electric field in the secondary electron emitting layer 1.

The transmission secondary electron emitter of this embodiment has a transmission type construction. One surface of the secondary electron emitting layer 1 is the surface of the incidence, and the other surface is the surface of the emission. The construction prevents the change in the surface condition of the surface of the emission, and the decrease in the discharge efficiency of the secondary electrons can be prevented. Since the secondary electron emitting layers 1 are formed by using diamond or a material containing diamond as a main component, the secondary electron emitting layer 1 can emit the secondary electrons efficiently for the incidence of the primary electrons.

The first electrode 35 is formed on the side of the surface of the incidence of the secondary electron emitting layer 1, and the second electrode 36 is formed on the side of the surface of the emission. Thereby, the electric field is formed in the secondary electron emitting layer 1. The electric field is formed in the secondary electron emitting layer 1, and the secondary electrons generated in the secondary electron emitting layer 1 are accelerated to the surface of the emission. Thereby the secondary electrons can be efficiently emitted outside of the transmission secondary electron emitter.

A supporting frame 22 is arranged as a supporting means at the outer edge part of the surface of the incidence of the secondary electron emitting layer 1. When it is necessary to reinforce the mechanical strength of the secondary electron emitting layer 1 formed thinly, the supporting means is arranged on the surface of the incidence in this embodiment, in addition to the surface of the emission as shown in FIG. 1, and thereby the mechanical strength of the secondary electron emitting layer 1 is suitably reinforced.

Figure 6A:
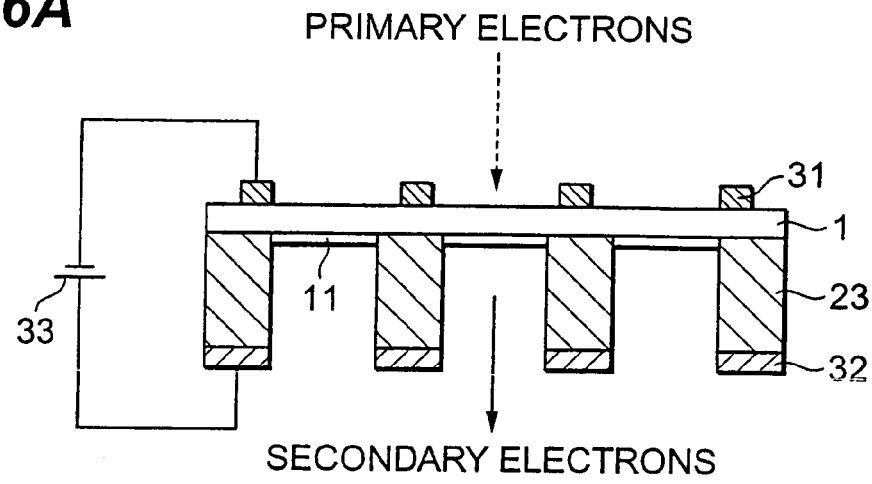
FIGS. 6A and 6B illustrate the construction of the transmission secondary electron emitter according to the fourth embodiment.
Figure 6B:
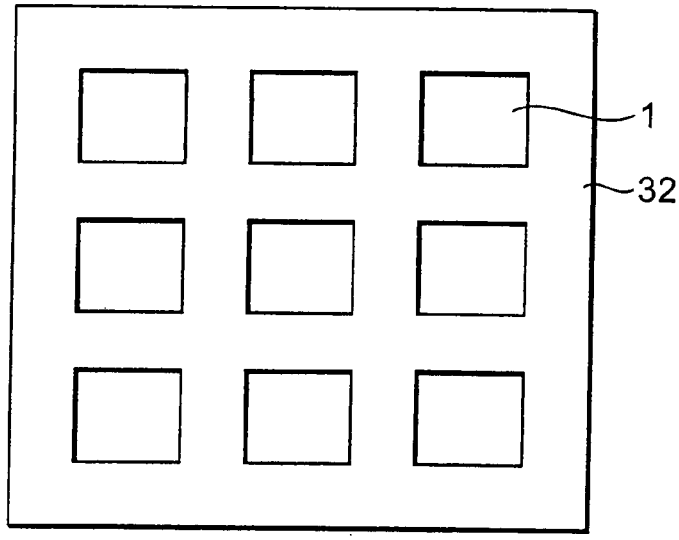

FIG. 6A and FIG. 6B illustrate the construction of the fourth embodiment of the transmission secondary electron emitter. FIG. 6A is a side cross-sectional view of the transmission secondary electron emitter, and FIG. 6B is a bottom view of the transmission secondary electron emitter seen from the side of the second electrode 32.

The transmission secondary electron emitter shown in FIG. 6A and FIG. 6B comprises the secondary electron emitting layer 1, the active layer 11, a supporting frame 23, a first electrode 31 and a second electrode 32. Of these, the constructions of the secondary electron emitting layer 1, the active layer 11 and the first electrode 31 are identical to those of the transmission secondary electron emitter shown in FIG. 1.

As shown in FIG. 6B, the supporting frame 23 is arranged in a lattice shape on the surface of the emission of the secondary electron emitting layer 1. The supporting frame 23 is formed such that the shape and area of each latticed frame are uniform. A second electrode 32 is formed on the whole surface of the side opposite the secondary electron emitting layer 1 of the supporting frame 23 arranged in a lattice shape.

The transmission secondary electron emitter of this embodiment has a transmission type construction in which one surface of the secondary electron emitting layer 1 is the surface of the incidence and the other surface is the surface of the emission. This prevents the change in the surface condition of the surface of the emission, and the decrease in the discharge efficiency of the secondary electrons can be prevented. The secondary electron emitting layer 1 is formed by using diamond or a material containing diamond as a main component. Thereby the secondary electron emitting layer 1 can emit the secondary electrons efficiently for the incidence of the primary electrons.

The first electrode 31 is formed on the side of the surface of the incidence of the secondary electron emitting layer 1, and the second electrode 32 is formed on the side of the surface of the emission. Thereby, the electric field is formed in the secondary electron emitting layer 1. The electric field is formed in the secondary electron emitting layer 1, and the secondary electrons generated in the secondary electron emitting layer 1 are accelerated to the surface of the emission. Thereby the secondary electrons can be efficiently emitted outside of the transmission secondary electron emitter.

The supporting frame 23 for reinforcing the mechanical strength of the secondary electron emitting layer 1 is arranged in a lattice shape. When the area of the secondary electron emitting layer 1 is comparatively small, the strength of the secondary electron emitting layer can be sufficiently reinforced by the support means having the shape shown in FIG. 1. However, the mechanical strength of the secondary electron emitting layer 1 can be further reinforced by arranging the supporting means having the shape of this embodiment when the area of the secondary electron emitting layer 1 is large and it is necessary to reinforce the mechanical strength of the secondary electron emitting layer 1 further.

At this time, when the supporting frame 23 is formed such that the shape and area of each latticed frame are uniform, the mechanical strength of the supporting frame 23 can be increased. The shape of the supporting means is not limited to the lattice shape, and the supporting frame 23 having various shapes may be used.

Though the second electrode 36 and the first electrode 31 are formed in a lattice shape in the third and fourth embodiments of the transmission secondary electron emitter, the electrodes may be formed in a thin film form as is the case with the first electrode film 31*a* in the second embodiment. The lattice shape, the thin film shape, or another shape can be properly selected as the shape of the electrode arranged on the surface of the secondary electron emitting layer 1.

The transmission secondary electron emitter described above can be used for electron tubes such as a photomultiplier tube and an image intensifier tube. The embodiment of the electron tube will be described as follows.

Figure 7:
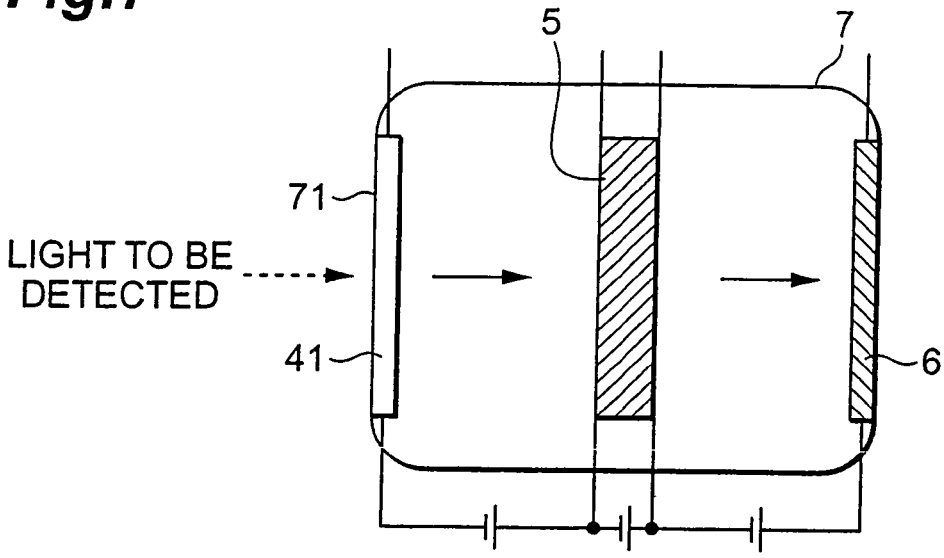
FIG. 7 is a sectional view schematically illustrating the construction of an embodiment of a photomultiplier tube as the first embodiment of an electron tube.

FIG. 7 is a sectional view schematically illustrating the construction of an embodiment of a photomultiplier tube as the first embodiment of an electron tube according to the present invention.

The photomultiplier tube shown in FIG. 7 comprises a photocathode 41 which converts light to be detected into photoelectrons and emits the photoelectrons, a transmission secondary electron emitter 5 which intensifies the photoelectron as the secondary electrons, an anode 6 for collecting secondary electrons intensified, and a vacuum envelope 7 accommodating them under a vacuum condition. The photocathode 41, the transmission secondary electron emitter 5 and the anode 6 are arranged at a predetermined interval in order from the side of the incidence of the light to be detected in the vacuum envelope 7.

The photocathode 41 is an electron source which emits the photoelectrons as the primary electrons to the transmission secondary electron emitter 5. In this embodiment, a transmission type photocathode is used, wherein the surface on which the light to be detected is made incident is different from the surface from which the photoelectrons are emitted. The reflection type photocathode may be used in addition to the transmission type photocathode 41.

The transmission secondary electron emitter 5 is formed at a predetermined distance from the photocathode 41. The above transmission secondary electron emitter which is made of diamond or a material containing diamond as a main component is used as the transmission secondary electron emitter 5. The transmission secondary electron emitter makes the photoelectrons emitted from the photocathode 41 incident from the surface of incidence as the primary electrons, and the secondary electrons are intensified. The secondary electrons are then emitted from the surface of the emission of the side opposite the surface of incidence. The anode 6 is arranged at a predetermined distance from the surface of the emission of the transmission secondary electron emitter 5. The anode 6 collects the secondary electrons emitted from the transmission secondary electron emitter 5.

The photocathode 41, the transmission secondary electron emitter 5 and the anode 6 are involved in the vacuum envelope 7 as an airtight container which is in the vacuum state. An entrance window 71 is formed on the surface on which the light to be detected is made incident, and which faces the photocathode 41 in the vacuum envelope 7. As a result, the light to be detected having a predetermined wavelength among the light made incident is efficiently made incident on the photocathode 41. A voltage is gradually applied to the photocathode 41, the transmission secondary electron emitter 5 and the anode 6 to form the electric field such that the side of the photocathode 41 is an electronegative potential and the side of the anode 6 is and electropositive potential.

When the light to be detected is made incident on the surface of the incidence of the photocathode 41 through the entrance window 71 in the above construction, the photoelectrons as the primary electrons are generated on the photocathode 41, and emitted in the vacuum of the vacuum envelope 7 from the surface of the emission. The electric field is formed by applying a voltage to the surface of the incidence of the transmission secondary electron emitter 5, a positive voltage relative to the photocathode 41. The photoelectrons emitted in the vacuum are accelerated, and made incident on the transmission secondary electron emitter 5.

The photoelectrons are intensified by corresponding to acceleration by the electric field on the transmission secondary electron emitter 5, and become the secondary electrons. The secondary electrons are emitted in the vacuum again. The electric field is formed by applying a voltage to the anode 6, a positive voltage relative to the surface of the emission of the transmission secondary electron emitter 5, and the secondary electrons emitted from the transmission secondary electron emitter 5 are collected in the anode 6. The secondary electrons are taken out outside of the photomultiplier tube as a detecting signal due to the incident light to be detected.

The photomultiplier tube shown in FIG. 7 is provided with the transmission secondary electron emitter 5 having the above construction. As a result, the secondary electrons can be efficiently obtained for the photoelectrons (primary electrons), and the photomultiplier tube capable of detecting the light to be detected can be achieved at a high secondary electronic multiplication factor. The high secondary electronic multiplication factor causes the accurate detection of the light to be detected at a high S/N ratio.

Figure 8:
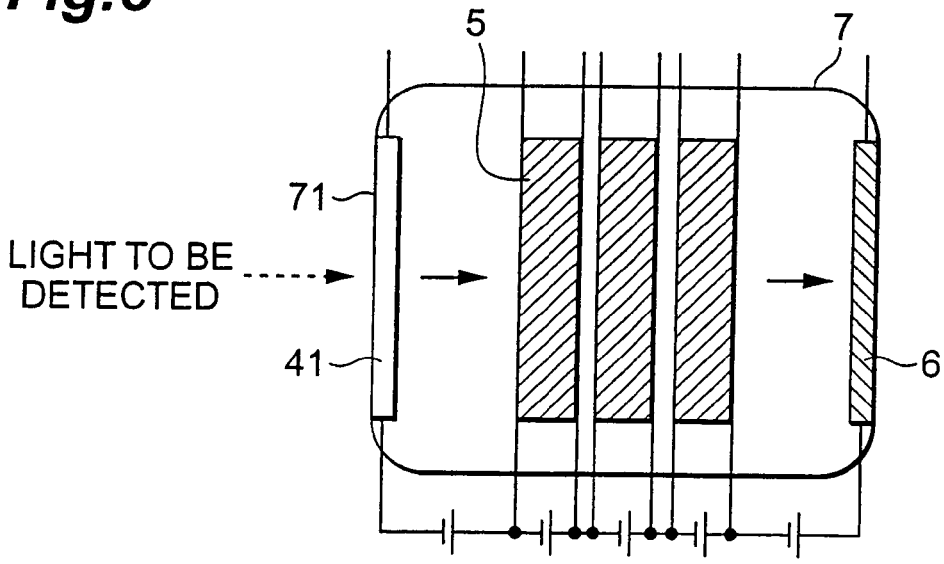
FIG. 8 is a sectional view schematically illustrating the construction of another embodiment of a photomultiplier tube as the second embodiment of an electron tube.

FIG. 8 is a sectional view schematically illustrating the construction of another embodiment of a photomultiplier tube as the second embodiment of an electron tube.

A photomultiplier tube shown in FIG. 8 comprises the photocathode 41, the transmission secondary electron emitter 5, the anode 6, and the vacuum envelope 7. Of these, the constructions of the photocathode 41, the anode 6 and the vacuum envelope 7 are identical to those of the photomultiplier tube shown in FIG. 7.

In this embodiment, a plurality of transmission secondary electron emitters 5 (three pieces in FIG. 8) are used. The above transmission secondary electron emitter made of diamond or a material containing diamond as a main component is used for a plurality of transmission secondary electron emitters 5. The plurality of transmission secondary electron emitters 5 are arranged at predetermined intervals such that the surfaces of incidence thereof face the surfaces of the emission respectively. The anode 6 is arranged at a predetermined distance from the surface of the emission of the transmission secondary electron emitter 5 at the furthermost position from the photocathode 41. The anode 6 collects the secondary electrons emitted from the transmission secondary electron emitter 5.

When the light to be detected is made incident on the photocathode 41 through the entrance window 71 in the above construction, the photoelectrons are generated on the photocathode 41, and emitted in the vacuum of the vacuum envelope 7. The photoelectrons emitted in the vacuum is made incident on the transmission secondary electron emitter 5 placed at the nearest position to the photocathode 41 as the primary electrons, and emitted as the intensified secondary electrons. The electrons are repeatedly intensified by a plurality of transmission secondary electron emitters 5 arranged afterwards. Finally, the secondary electrons intensified are collected in the anode 6, and the secondary electrons are taken out outside of the photomultiplier tube as the detecting signal by the incident light to be detected.

In the photomultiplier tube shown in FIG. 8, the plurality of transmission secondary electron emitters 5 having the above construction are used, and thereby the photomultiplier tube capable of detecting the light to be detected can be achieved at a higher secondary electronic multiplication factor. As a result, the high secondary electronic multiplication factor causes the accurate detection of the light to be detected at higher S/N ratio.

Even when it is necessary to use a plurality of secondary electron emitters as in this embodiment, a plurality of second electron surfaces can be thinly stacked if the above transmission secondary electron emitter 5 is used.

Though the above photomultiplier tube of each embodiment has a so-called adjacent type construction such that the photocathode 41 faces the transmission secondary electron emitter 5 and the anode 6, the photomultiplier tube may have a so-called electrostatic focusing type construction such that an electrostatic lens is provided between the photocathode 41 and the transmission secondary electron emitter 5, and the photoelectrons are focused.

Though the anode 6 for collecting the secondary electrons is provided, a semiconductor element such as a photodiode may be provided instead of the anode 6. Each embodiment of the above photomultiplier tube can be suitably executed by bombarding the secondary electrons directly to the semiconductor element, that is, by operating as a so-called electron bombardment type photomultiplier tube.

Figure 9:
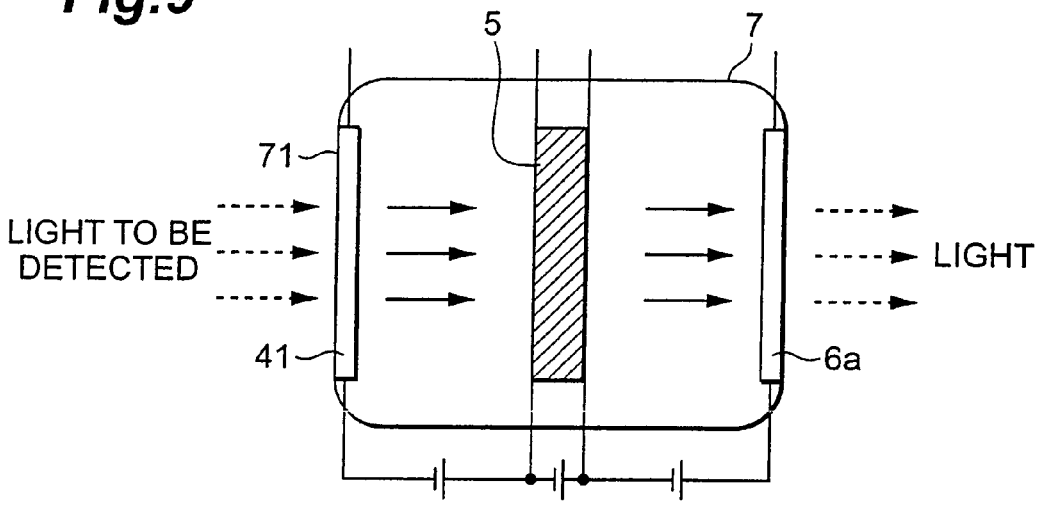
FIG. 9 is a sectional view schematically illustrating the construction of an image intensifier tube as the third embodiment of an electron tube.

FIG. 9 is a sectional view schematically illustrating the construction of an image intensifier tube as the third embodiment of an electron tube.

An image intensifier tube shown in FIG. 9 comprises the photocathode 41, the transmission secondary electron emitter 5, an anode 6*a*, and the vacuum envelope 7. Of these, the constructions of the photocathode 41, the transmission secondary electron emitter 5 and the vacuum envelope 7 are identical to those of the photomultiplier tube shown in FIG. 7.

The anode 6*a* has a function for collecting the secondary electrons emitted from the transmission secondary electron emitter 5, and is arranged at a predetermined distance from the surface of the emission of the transmission secondary electron emitter 5. The anode 6*a* has a fluorescent screen including a fluorescent material emitting light by the incidence of the electron.

When the light to be detected composing the image transmits the entrance window 71, and is made incident on the photocathode 41 in the above construction, the photoelectrons are generated in the photocathode 41, and are emitted in the vacuum envelope 7. The photoelectrons emitted are made incident on the transmission secondary electron emitter 5. At this time, the electric field is formed by applying a voltage to the surface of incidence of the transmission secondary electron emitter 5, a positive voltage relative to the photocathode 41. Since the photoelectrons advance in parallel with the electric field, the photoelectrons are made incident on the transmission secondary electron emitter 5 while keeping two dimensional information at the time of being made incident on the image intensifier tube.

The photoelectrons made incident on the transmission secondary electron emitter 5 are intensified, and are emitted as the secondary electrons. The secondary electrons are collected in the anode 6*a* having a fluorescent screen. At this time, a voltage is applied to the anode 6*a*, a positive voltage relative to the surface of emission of the transmission secondary electron emitter 5. As a result, the electric field is formed on the anode 6*a*, and the secondary electrons are collected in the anode 6*a* while keeping two dimensional information that the photoelectrons have. Thereby the fluorescent screen of the anode 6*a* emits light. An image due to the light to be detected made incident on the image intensifier tube is intensified by the above operation, and is output from the fluorescent screen of the anode 6*a* as the image.

The image intensifier tube can be obtained, in which the secondary electrons can be efficiently obtained for the incidence of the light to be detected by using the transmission secondary electron emitter 5 having the above construction in the image intensifier tube shown in FIG. 9. As a result, the image having high luminance can be obtained, and the image can be accurately reproduced at high S/N ratio even if the image incident is weak.

Though the fluorescent screen is used as a means for emitting light by the secondary electrons in the above image intensifier tube, the means should at least convert the electrons into the image. For instance, similar effects can be achieved by providing an image pickup device such as a charge coupled device (CCD) instead of the anode 6*a* having the fluorescent screen, driving the secondary electrons directly to the image pickup device, and imaging them.

Figure 10:
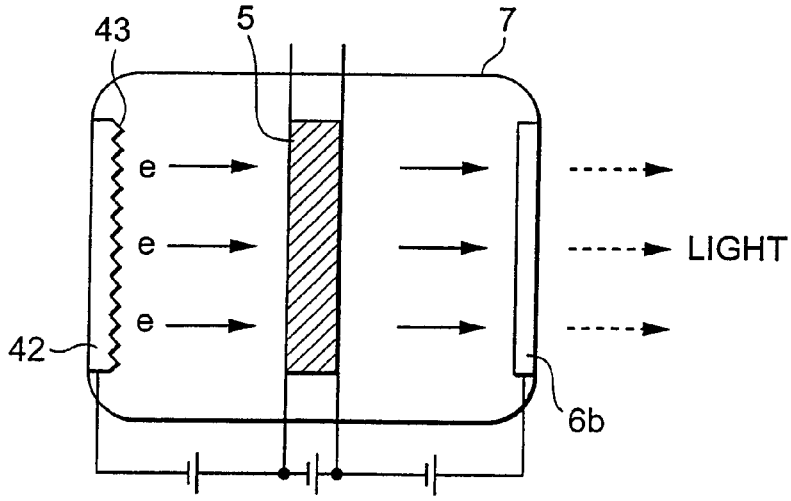
FIG. 10 is a sectional view schematically illustrating the construction of a plane display device as the fourth embodiment of an electron tube.
Figure 11:
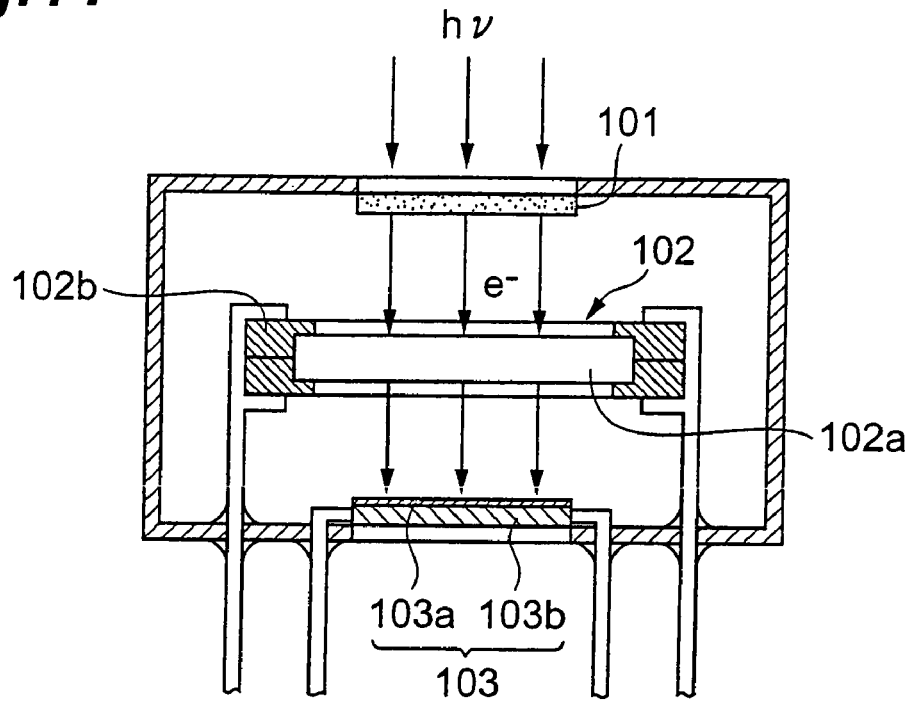
Fig.11 PRIOR ART
FIG. 11 is a construction view illustrating an embodiment of an electron tube provided with a conventional transmission secondary electron emitter.
Figure 12:
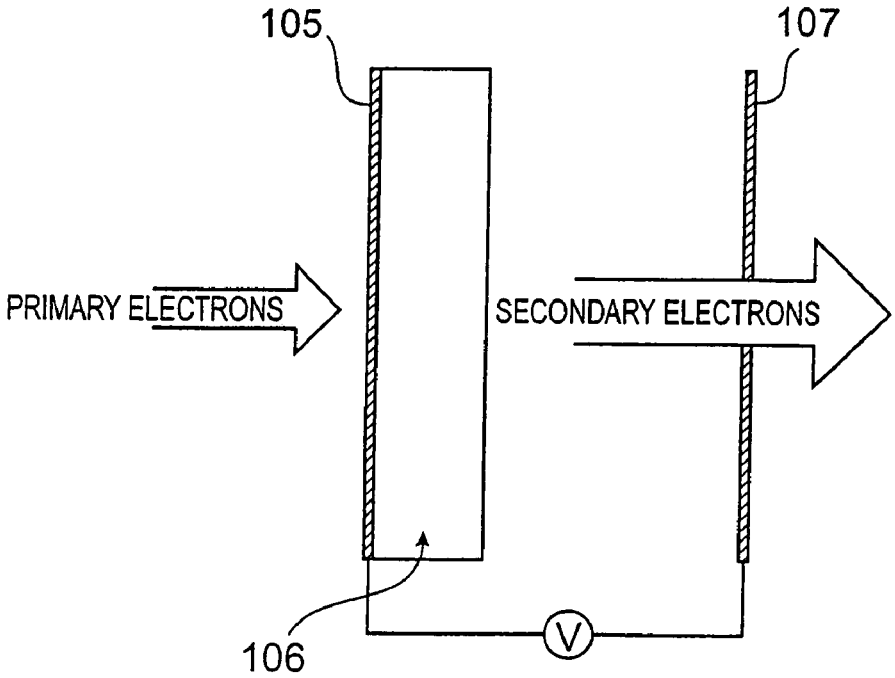
Fig.12 PRIOR ART
FIG. 12 is a construction view illustrating another embodiment of a conventional transmission secondary electron emitter.

FIG. 10 is a sectional view schematically illustrating the construction of a plane display device as the fourth embodiment of an electron tube.

A plane display device shown in FIG. 10 is a field emission display comprising a field emission electron source array 42, the transmission secondary electron emitter 5, an anode 6*b* and the vacuum envelope 7. Of these, the constructions of the transmission secondary electron emitter 5 and the vacuum envelope 7 are identical to those of the image intensifier tube shown in FIG. 9.

The anode 6*b* has a function for collecting the secondary electrons, and is arranged at a predetermined distance from the surface of the emission of the transmission secondary electron emitter 5. The anode 6*b* has a fluorescent screen including a fluorescent material emitting light by the incidence of the electron. Pixels of RGB are arranged on the fluorescent screen, and the image is displayed by the incidence of the electron.

The field emission electron source array 42 has a construction in which a lot of field emission electron sources 43 are arranged in an array. The field emission electron sources 43 emit the electrons corresponding to the respective pixels of RGB of the image output in the plane display device.

In the above construction, the electrons corresponding to respective pixels of the image output are emitted from the field emission electron source 43 to the vacuum envelope 7. The electrons emitted are made incident on the transmission secondary electron emitter 5. At this time, the electric field is formed by applying a voltage to the surface of the incidence of the transmission secondary electron emitter 5, a positive voltage relative to the field emission electron source array 42. Since the electrons advance in parallel with the electric field, the electrons are made incident on the transmission secondary electron emitter 5 while keeping two dimensional information at the time of being emitted from the field emission electron source 43.

The secondary electrons are generated and emitted by the electrons made incident on the transmission secondary electron emitter 5, and are collected in the anode 6*b* having the fluorescent screen. At this time, a voltage is applied to the anode 6*b*, a positive voltage relative to the surface of emission of the transmission secondary electron emitter 5. As a result, the electric field is formed on the anode 6*b*, and the secondary electrons are collected in the anode 6*b* while keeping two dimensional information that the electrons have. A predetermined pixel emits light on the fluorescent screen of the anode 6*b*. The electrons corresponding to respective pixels of the image output are emitted from field emission electron source 43 by the above operation, and the secondary electrons generated on the transmission secondary electron emitter 5 make a fluorescent screen emit light. As a result, a predetermined image is output.

In the plane display device shown in FIG. 10, the secondary electrons can be efficiently obtained for the input of the electrons (primary electrons) by using the transmission secondary electron emitter 5 having the above construction, and the plane display device which makes the fluorescent screen emit light can be achieved. As a result, the output of the image of the plane display device can be further made high luminance. Since ions generated by accelerating a large amount of electrons to the fluorescent screen and making the electrons incident on the fluorescent screen do not reach the field emission element directly, the plane display device work is long-lived and can be stably operated.

Herein, a field emission electron source array 42 is provided, in which a lot of field emission electron sources 43 are arranged in an array as the electron source for emitting the electrons corresponding to the image output in this embodiment. A gate electrode, a focusing electrode or other electron sources can be used as the electron source used in this embodiment in addition to the above electron source. As a result, the fluorescent display tube having the effects the same as the above plane display device can be achieved.

When it is necessary to use a plurality of secondary electron emitters in the image intensifier tube of the third embodiment and the plane display device of the fourth embodiment as is the case with the photomultiplier tube of the above second embodiment, a plurality of secondary electron emitters can be thinly stacked by using the above transmission secondary electron emitter 5, and necessary brightness can be obtained on the fluorescent screen.

The transmission secondary electron emitter and the electron tube according to the present invention is not limited to the above embodiment, and various changes can be made. For instance, when the mechanical strength of secondary electron emitting layer 1 is sufficient in each embodiment of the transmission secondary electron emitter, the supporting frames 21–23 for reinforcing the mechanical strength may not be provided. When the secondary electrons can be efficiently emitted from the secondary electron emitting layer 1, the active layer 11 for lowering the work function of the surface of the emission of the secondary electron emitting layer 1 may not be arranged.

When it is necessary to reinforce the mechanical strength of the vacuum envelope 7 for enlargement or the like in each embodiment of the electron tube, a reinforcing means such as a spacer is preferably provided in the vacuum envelope 7 such as between the electron source and the transmission secondary electron emitter, and between the transmission secondary electron emitter and the anode.

INDUSTRIAL APPLICABILITY

As has been described in detail above, the transmission secondary electron emitter and the electron tube according to the present invention achieve the following effects. The transmission secondary electron emitter can efficiently emit the secondary electrons for incidence of the primary electrons, and the electron tube use the same. That is, the transmission secondary electron emitter has a transmission construction in which one surface of the secondary electron emitting layer is the surface of incidence, and the other surface is the surface of emission. Thereby the construction prevents the change in the surface condition of the surface of the emission by the incidence of the primary electrons, and the decrease in the emission efficiency of the secondary electrons can be prevented.

The secondary electron emitting layer is made of diamond or a material containing diamond as a main component, and thereby the secondary electrons can be emitted with high efficiency. The voltage applying means forms the electric field in the secondary electron emitting layer. Thereby the secondary electrons reach the surface of emission easily, and the secondary electrons can be emitted with high efficiency.

The use of the transmission secondary electron emitter for the electron tube provides an electron tube which can efficiently obtain the secondary electrons from the primary electrons of the electron source.

The invention claimed is:

1. A transmission secondary electron emitter which emits secondary electrons generated by the incidence of primary electrons, the transmission secondary electron emitter comprising:

a secondary electron emitting layer which is made of diamond or a material containing diamond as a main component, and of which one surface is the surface of incidence for making the primary electrons incident thereon from a position outside of the secondary electron emitting layer, and the other surface is the surface of emission for emitting the secondary electrons corresponding to the incident energy of the primary electrons and generated in the secondary electron emitting layer; and a voltage applying means for applying a predetermined voltage between the surfaces of the incidence and the emission of the secondary electron emitting layer, wherein the voltage applying means includes a first electrode formed on the side of the surface of the incidence and a second electrode formed on the side of the surface of the emission for applying the predetermined voltage to form an electric field in the secondary electron emitting layer for accelerating the secondary electrons in the direction to the surface of the emission.

2. The transmission secondary electron emitter according to claim 1, further comprising a supporting means for reinforcing the mechanical strength of the secondary electron emitting layer.

3. The transmission secondary electron emitter according to claim 1, wherein the secondary electron emitting layer is made of polycrystalline diamond or a material containing polycrystalline diamond as a main component.

4. The transmission secondary electron emitter according to claim 3, wherein the surface and the grain boundary face of the polycrystalline diamond of the secondary electron emitting layer are terminated with oxygen.

5. The transmission secondary electron emitter according to claim 1, wherein the surface of the emission of the secondary electron emitting layer is terminated with hydrogen.

6. The transmission secondary electron emitter according to claim 1, wherein the surface of the emission of the secondary electron emitting layer is terminated with oxygen.

7. The transmission secondary electron emitter according to claim 1, wherein an active layer for lowering the work function of the secondary electron emitting layer is formed on the surface of the emission of the secondary electron emitting layer.

8. The transmission secondary electron emitter according to claim 7, wherein the active layer of the secondary electron emitting layer comprises an alkali metal, an oxide of the alkali metal, or a fluoride of the alkali metal.

9. An electron tube comprising:

the transmission secondary electron emitter according to claim 1;

an electron source for emitting the primary electrons to the transmission secondary electron emitter;

an anode for collecting the secondary electrons emitted from the transmission secondary electron emitter; and an envelope for accommodating the transmission secondary electron emitter, the electron source, and the anode.

10. The electron tube according to claim 9, wherein the electron source includes a photocathode for emitting photoelectrons excited by incident light to be detected as the primary electrons.

11. The electron tube according to claim 9, wherein the electron source includes a photocathode for emitting photoelectrons excited by incident light to be detected as the primary electrons, and the anode has a fluorescent screen emitting light by the incidence of the secondary electrons.

12. The electron tube according to claim 9, wherein the electron source includes a field emission electron source, and the anode has a fluorescent screen emitting light by the incidence of the secondary electrons.

13. The electron tube according to claim 9, wherein the electron source includes a field emission electron source array in which a plurality of field emission electron sources are arranged in an array, and the anode has a fluorescent screen emitting light by the incidence of the secondary electrons.

* * * * *